United States Patent [19]

Anderberg et al.

[11] 4,042,266

[45] Aug. 16, 1977

[54] EXTENSIBLE SAFETY LATCH MEANS FOR PIVOTABLE WINDOWS

[75] Inventors: Axel W. Anderberg, Los Angeles; George A. Taylor, LaCrescenta, both of Calif.

[73] Assignee: A. W. Anderberg Manufacturing Co., Los Angeles, Calif.

[21] Appl. No.: 705,802

[22] Filed: July 16, 1976

[51] Int. Cl.[2] ..... E05C 17/06

[52] U.S. Cl. ..... 292/267; 292/DIG. 4; 292/DIG. 33

[58] Field of Search ..... 292/DIG. 33, DIG. 4, 292/273, 338, 267, 270, 274, 266, 269; 49/248; 160/71, 80; 135/20

[56] References Cited

U.S. PATENT DOCUMENTS

| | | | |
|---|---|---|---|
| 565,924 | 8/1896 | Richards | 160/80 |
| 1,140,852 | 5/1915 | Roeder | 292/DIG. 4 |
| 1,693,860 | 12/1928 | Olson | 292/338 X |
| 2,566,182 | 8/1951 | Flynn | 292/267 X |

FOREIGN PATENT DOCUMENTS

| | | | |
|---|---|---|---|
| 1,354,883 | 5/1974 | United Kingdom | 70/238 |

*Primary Examiner*—Richard E. Moore
*Attorney, Agent, or Firm*—Lyon & Lyon

[57] ABSTRACT

An extensible safety latch means comprising two telescoping bar members attached at their extremities to a fixed window frame and an inwardly pivotable window frame, the bars having a first key operated latch means for limiting movement of the pivotable window frame to a safe distance from the fixed window frame insufficient for passage of a child, and a second latch means for securing the movable window frame in an extended inward position as needed to clean the window.

3 Claims, 8 Drawing Figures

EXTENSIBLE SAFETY LATCH MEANS FOR PIVOTABLE WINDOWS

BACKGROUND

Pivotable windows are widely used. It is desirable that they be arranged so that they cannot be opened a distance sufficient for exit of a person including a child; however, such limitation poses a cleaning problem. Usually cleaning is accomplished by workmen using exterior elevator scaffolding. To avoid cleaning from the exterior of the building, the windows may be mounted to swing inwardly; however, in order to wash the window, it need be fully opened. To do this a hand release is used which often is such that it may be released by anyone including a child.

SUMMARY

The present invention is directed to an extensible safety latch means which is attached to an inwardly pivotable window, the latch means including a first latch unit being so arranged that the windows may be readily opened a limited distance such that a person, including a child, cannot exit or enter, however, by use of a key, the latch unit may be released for inward movement of the window sufficient to permit cleaning and, when so opened, is secured by a second latch unit to prevent movement of the window during the cleaning operation.

DETAILED DESCRIPTION

Figures 1, 2, 3, 4, 5, 6, 7, 8:
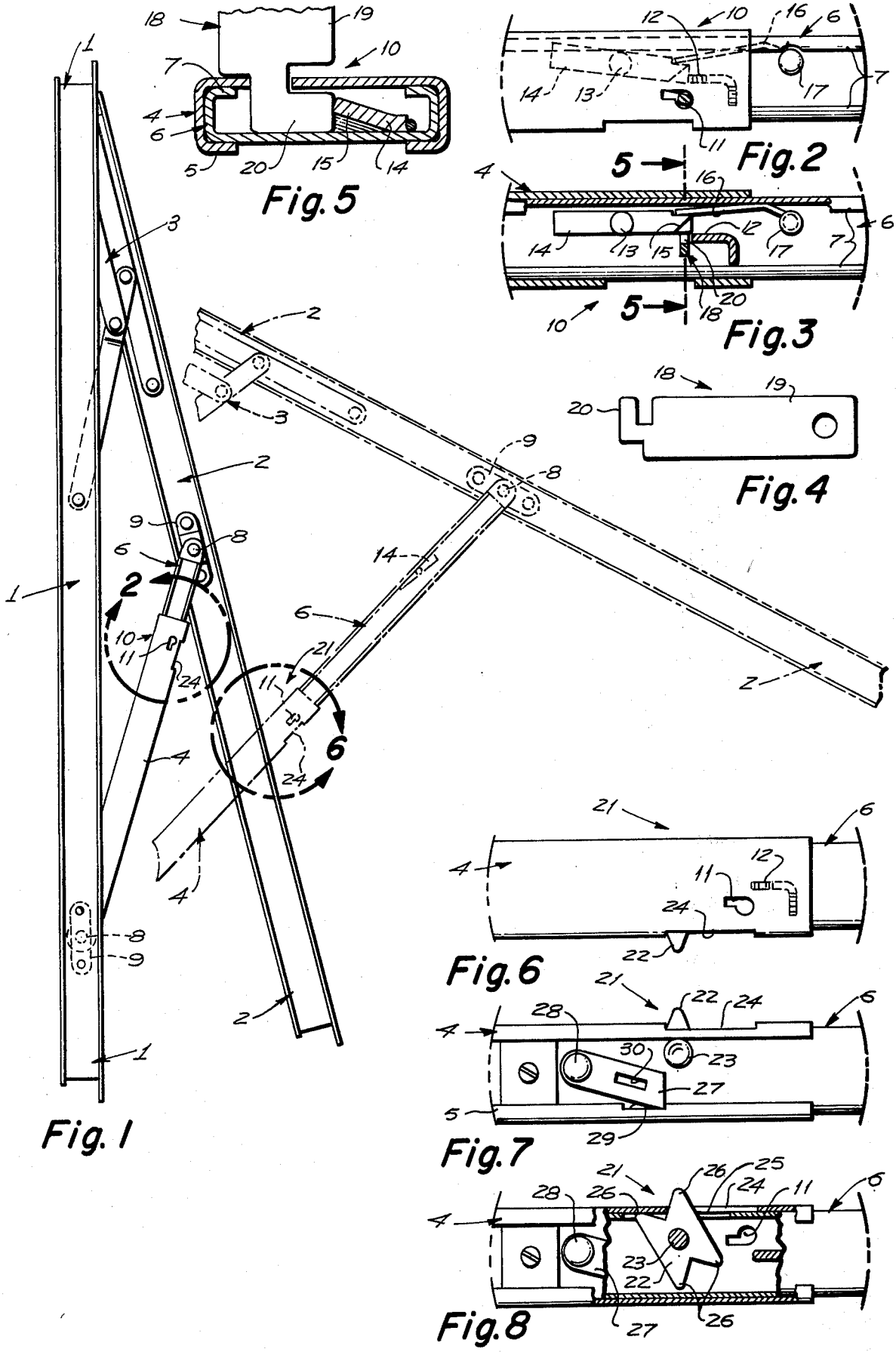
FIG. 1 is a side view of a pivotal window utilizing the extensible safety latch means, the window being shown by solid lines in its exit restraining position and fragmentarily by broken lines in position for washing.
FIG. 2 is an enlarged fragmentary side view taken within Circle 2 of FIG. 1.
FIG. 3 is a similar enlarged view taken in section.
FIG. 4 is a side view of the key member.
FIG. 5 is an enlarged transverse sectional view taken through 5—5 of FIG. 3, showing the key member holding the latch mechanism in its unlatched position.
FIG. 6 is an enlarged fragmentary side view taken within Circle 6 of FIG. 1 showing the latch assembly operable to hold the window in position for washing.
FIG. 7 is a fragmentary side view showing the opposite side of the latch bars.
FIG. 8 is a fragmentary view similar to FIG. 7 with portions broken away and in section to illustrate the internal elements.

A window structure suitable for the extensible safety latch means includes a fixed frame 1 preferably of metal, and a pivotal frame 2 also of metal. The two frames are joined by multiple link pivot hinge assembly 3, which is more fully disclosed in U.S. Pat. No. 3,345,777.

The extensible safety latch means includes an outer latch bar 4 having inturned side margins 5 and an inner latch bar 6, also having internal side margins 7. The latch bar 6 is narrower than the latch bar 4 so that the inner latch bar 6 may telescope into the outer latch bar 4. The remote extremities of the latch bars 4 and 6 are joined by pivots 8 to mounting brackets 9 which in turn are suitably secured to the appropriate sides of the fixed frame 1 and pivotal frame 2.

A first latch assembly 10 connects the bars 4 and 6 and is shown in FIGS. 2 through 5. The latch assembly 10 includes a key slot 11 formed in the outer latch bar 4. Secured to the latch bar 4, adjacent the key slot 11 is an L-shaped stop boss 12 which projects toward the inner latch bar 6. Pivotally mounted by a pin 13 secured in the inner latch bar 6 is a keeper lever 14 having a raised corner 15. The keeper lever is urged in a direction to engage the stop boss 12 by a spring 16 secured at one end by a retainer pin 17.

A key 18 having a shank 19 and an L-shaped key element 20 is provided, the key element 20 is received in the key slot 11, as indicated in FIG. 2, whereupon it may be turned to the position shown in FIGS. 3 and 5 to urge the keeper lever 14 clear of the stop boss 12.

The key slot 11 and stop boss 12 are located adjacent the telescoping end of the outer latch bar 14 and the location of the keeper lever 14 is such that the keeper lever engages the stop boss 12 when the pivotal frame 2 is moved a predetermined distance from the fixed frame 1 as shown in FIG. 1. The spacing between the frames is such that a person, including a child, cannot exit between the frames.

For purposes of cleaning the window it is necessary that the pivotal frame 2 be extended, as shown by broken lines in FIG. 1. This can be accomplished when the key has moved the keeper lever 14 clear of the stop boss 12.

A second latch assembly 21 is provided which includes the region of the first latch assembly 10 with respect to the outer latch bar 4 and the extended end of the inner latch bar 6, as indicated by broken lines in FIG. 1.

The second latch assembly includes a sequencing latch 22 joined to the inner latch bar 6 by a pivot 23. The two latch bars 4 and 6 are provided in corresponding side margins 7 with slots 24 and 25, which are registered when the latch bars are in the position shown in FIGS. 6 through 8. The sequencing latch 22 is provided with four pivot prongs 26 so arranged that when the two latch bars are moved back and forth a distance limited by the slots 24 and 25, the sequencing latch 22 turns progressively, this is accomplished by alternate engagement of the prongs 26 with the slot 24 and the stop boss 12.

It should be observed that the sequencing latch 22 is conventional. However, if forces applied intermittently to the pivotable frame 2 as may be the case during washing of the window, the sequencing latch may be moved to a position permitting collapse or closure of the window. To avoid this possibility, a keeper lever 27 is secured adjacent the end of the inner latch bar 6 by a pivot 28, the lever 27 extends in a direction opposite from the direction of telescopic movement between the bars. The extremity of the lever 27 engages a keeper notch 29 provided in a margin 5 of the outer latch bar 4, as shown in FIG. 7. The keeper lever 27 may be provided with a slot 30 dimensioned to receive the end of the key to facilitate turning the lever so as to disengage the keeper notch 29.

For purposes of washing the window, the first latch assembly 10 is unlatched by use of the key 18, the pivotable window is moved to its extreme position limited by the second latch assembly 21 whereupon the keeper lever 27 is moved into engagement with the notch 29 so as to prevent manipulation of the sequencing latch 22 that would result in closure of the pivotal frame 2.

Having fully described our invention it is to be understood that we are not to be limited to the details herein set forth, but that our invention is of the full scope of the appended claims.

We claim:

1. The combination with a window having a fixed window frame, a pivoted window frame, and hinge means joining the frames, of an extensible safety latch means, comprising:

a. a pair of telescopable bar members including confronting portions defining an elongated chamber;

b. means of pivotally attaching the remote ends of the bars members to the fixed and pivotal window frames;

c. a latch assembly including mutually engagable latch elements carried by the bar members for limiting movement of the pivotable window frame to a preselected position, a stop projecting into the chamber, and a lever pivotally mounted in the chamber and movable between a position engaging the stop, and a position clearing the stop;

d. and a key member engagable with one of the latch elements to separate the latch elements thereby to permit further movement of the pivotal window;

e. one of the members having a key opening providing access to the lever, and dimensioned to receive the key member for effecting disengagement of the lever from the top.

2. The combination with a window having a fixed frame and a pivotable frame set in the fixed frame and hinged thereto, of an extensible latch means, comprising:

a. a pair of telescopable bar members having spaced confronting flat portions and inturned side margins forming an elongated latch receiving chamber;

b. means pivotally connecting the remote ends of the bar members to the fixed and pivotable frames;

c. a first latch means disposed in the chamber for limiting movement of the pivotable frame to a position calculated to prevent exit through the window, the first latch means being key releasable;

d. a second latch means disposed in the chamber, operable upon key release of the first latch means to secure the pivotable frame in position permitting cleaning of the external side of the window.

3. A combination as set forth in claim 2, wherein:

a. an element of the first latch means is utilized in the operation of the second latch means.

* * * * *